US009703248B2

(12) United States Patent
Fujita

(10) Patent No.: US 9,703,248 B2
(45) Date of Patent: Jul. 11, 2017

(54) CURLING DETECTION DEVICE, IMAGE FORMING APPARATUS, CURLING DETECTION METHOD, IMAGE ADJUSTMENT METHOD, RECORDING MEDIUM STORING A CURLING DETECTION PROGRAM, AND RECORDING MEDIUM STORING AN IMAGE ADJUSTMENT PROGRAM

(71) Applicant: Hayato Fujita, Kanagawa (JP)

(72) Inventor: Hayato Fujita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 2 days.

(21) Appl. No.: 14/707,137

(22) Filed: May 8, 2015

(65) Prior Publication Data

US 2015/0331377 A1 Nov. 19, 2015

(30) Foreign Application Priority Data

May 16, 2014 (JP) ..... 2014-101890

(51) Int. Cl.
*G03G 15/16* (2006.01)
*G03G 15/00* (2006.01)
*G03G 15/01* (2006.01)

(52) U.S. Cl.
CPC ..... *G03G 15/6576* (2013.01); *G03G 15/5058* (2013.01); *G03G 15/0189* (2013.01); *G03G 15/162* (2013.01); *G03G 15/1605* (2013.01); *G03G 15/5054* (2013.01)

(58) Field of Classification Search
CPC ..... G03G 15/5054; G03G 15/5058; G03G 15/0189; G03G 15/1605; G03G 15/162
See application file for complete search history.

(56) References Cited

U.S. PATENT DOCUMENTS 6,128,459 A * 10/2000 Iwata et al. ..... 399/301
7,697,876 B2 * 4/2010 Nakatsu ..... 399/301

FOREIGN PATENT DOCUMENTS

JP 2012-088639 5/2012

* cited by examiner

*Primary Examiner* — Laura Martin
*Assistant Examiner* — John M Royston
(74) *Attorney, Agent, or Firm* — Harness, Dickey & Pierce, P.L.C.

(57) ABSTRACT

A curling detection device includes an endless belt entrained around at least two rollers, a conveyance unit that conveys the endless belt by driving the rollers, an image forming unit that forms an image by transferring a toner image to either a surface of the endless belt directly or a recording medium on the endless belt, a pattern image forming controller that instructs the image forming unit to form lines of a curling detection pattern at predetermined intervals in a conveying direction of the endless belt and a predetermined angle against the conveying direction of the endless belt at a predetermined timing, a curling scanning unit that scans the curling detection pattern, and a detecting unit that detects a curling of the endless belt based on the interval of the curling detection pattern scanned by the curling scanning unit.

18 Claims, 9 Drawing Sheets

CURLING DETECTION DEVICE, IMAGE FORMING APPARATUS, CURLING DETECTION METHOD, IMAGE ADJUSTMENT METHOD, RECORDING MEDIUM STORING A CURLING DETECTION PROGRAM, AND RECORDING MEDIUM STORING AN IMAGE ADJUSTMENT PROGRAM

CROSS-REFERENCE TO RELATED APPLICATION

This patent application is based on and claims priority pursuant to 35 U.S.C. §119(a) to Japanese Patent Application No. 2014-101890, filed on May 16, 2014 in the Japan Patent Office, the entire disclosure of which is hereby incorporated by reference herein.

BACKGROUND

Technical Field

The present invention relates to a curling detection device, an image forming apparatus, a curling detection method, an image adjustment method, a non-transitory recording medium storing a curling detection program, and a non-transitory recording medium storing an image adjustment program.

Background Art

Tandem-type electrophotographic color image forming apparatuses, in which image forming units that form images in four colors, black, cyan, magenta, and yellow are disposed along an endless conveyance belt or an intermediate transfer belt that conveys a recording medium (hereinafter referred to as a "sheet") is known in the art.

In the image forming units of each color, a writing unit irradiates a photoconductor with a laser beam modulated by image data and an electrostatic latent image is formed on the photoconductor. Toner images in each color are formed by supplying toner of each color to the photoconductor on which the electrostatic latent image is formed, and a color image is formed by transferring the toner image on the photoconductor for each color on the sheet conveyed on the conveyance belt or the intermediate transfer belt. In case of transferring an image on the intermediate transfer belt, the color image forming apparatus transfers the color image on the intermediate transfer belt to the sheet fed from a paper feeding unit using a transfer roller.

As described above, in the color image forming apparatus that includes multiple image forming units, unlike a single-drum color image forming apparatus that has only one photoconductor and forms a color image, the color image is formed by superimposing toner images in different colors sequentially on the same sheet or the same surface of the intermediate transfer belt using each of the image forming units. Therefore, if the intervals between the images formed by each of the image forming units is shifted or where those images are imposed on a position on the sheet or the intermediate transfer belt where the image is transferred by each of the image forming units is shifted, image quality deteriorates.

To cope with this issue, a color image forming apparatus that forms predetermined color toner patterns in each color on the sheet, the conveyance belt, or the transfer belt and calculates displacements in the main scanning direction and the sub-scanning direction, magnification shift, skew, and curve by detecting those color toner patterns (especially the interval between the toner patterns) with an optical sensor and reduces color shift by performing feedback correction is known in the art. This so-called color shift correction process is performed when the image forming apparatus is turned on, when environmental conditions such as temperature change, or when the number of printed sheets reaches or exceeds a predetermined threshold. As a result, the amount of color shift always becomes equal to or smaller than a predetermined range.

However, in case of forming the color toner patterns on the intermediate transfer belt, it is impossible to correct color shift precisely if a color order of the color toner patterns gets reversed due to deterioration of the intermediate transfer belt or changes in the environment such as temperature. In some cases, curling of the conveyance roller itself that tensions the conveyance belt or the intermediate transfer belt changes the color order of the color toner patterns described above.

Accordingly, in an image forming apparatus constructed of an image bearer that bears toner images such as a position adjustment pattern and a density adjustment pattern for color matching formed by a toner image forming unit, a rotatable endless belt tensioned by at least two rollers, a transferring unit that transfers the toner image on the image bearer to the surface of the endless belt, and a detecting unit that detects the position adjustment pattern and/or the density adjustment pattern transferred on the surface of the endless belt by the transferring unit, the detecting unit detects curling by rotating the endless belt at least once, and, if curling is detected, the position adjustment pattern and/or the density adjustment pattern is formed so that they are not superimposed on the curled part, and the endless belt is stopped so that the curling is positioned at the roller that caused the curling.

That is, in the technology described above, the endless belt on which the toner image is transferred is rotated at least once, the detecting unit detects curling of the endless belt, and the position adjustment pattern and the density adjustment pattern is formed so that they are not superimposed on the curling and color shift correction is performed.

SUMMARY

An example embodiment of the present invention provides a novel curling detection device that includes an endless belt entrained around at least two rollers, a conveyance unit that conveys the endless belt by driving the rollers, an image forming unit that forms an image by transferring a toner image to either a surface of the endless belt directly or a recording medium conveyed on the endless belt, a pattern image forming controller that instructs the image forming unit to form lines of a curling detection pattern at predetermined intervals in a conveying direction of the endless belt and a predetermined angle against the conveying direction of the endless belt at a predetermined timing, a curling scanning unit that scans the curling detection pattern, and a detecting unit that detects a curling of the endless belt based on the interval of the curling detection pattern scanned by the curling scanning unit.

Further example embodiments of the present invention provide a curling detecting method and a non-transitory recording medium storing a curling detecting program.

BRIEF DESCRIPTION OF THE DRAWINGS

A more complete appreciation of the disclosure and many of the attendant advantages thereof will be readily obtained as the same becomes better understood by reference to the following detailed description when considered in conjunction with the accompanying drawings.

DETAILED DESCRIPTION

Figure 1:
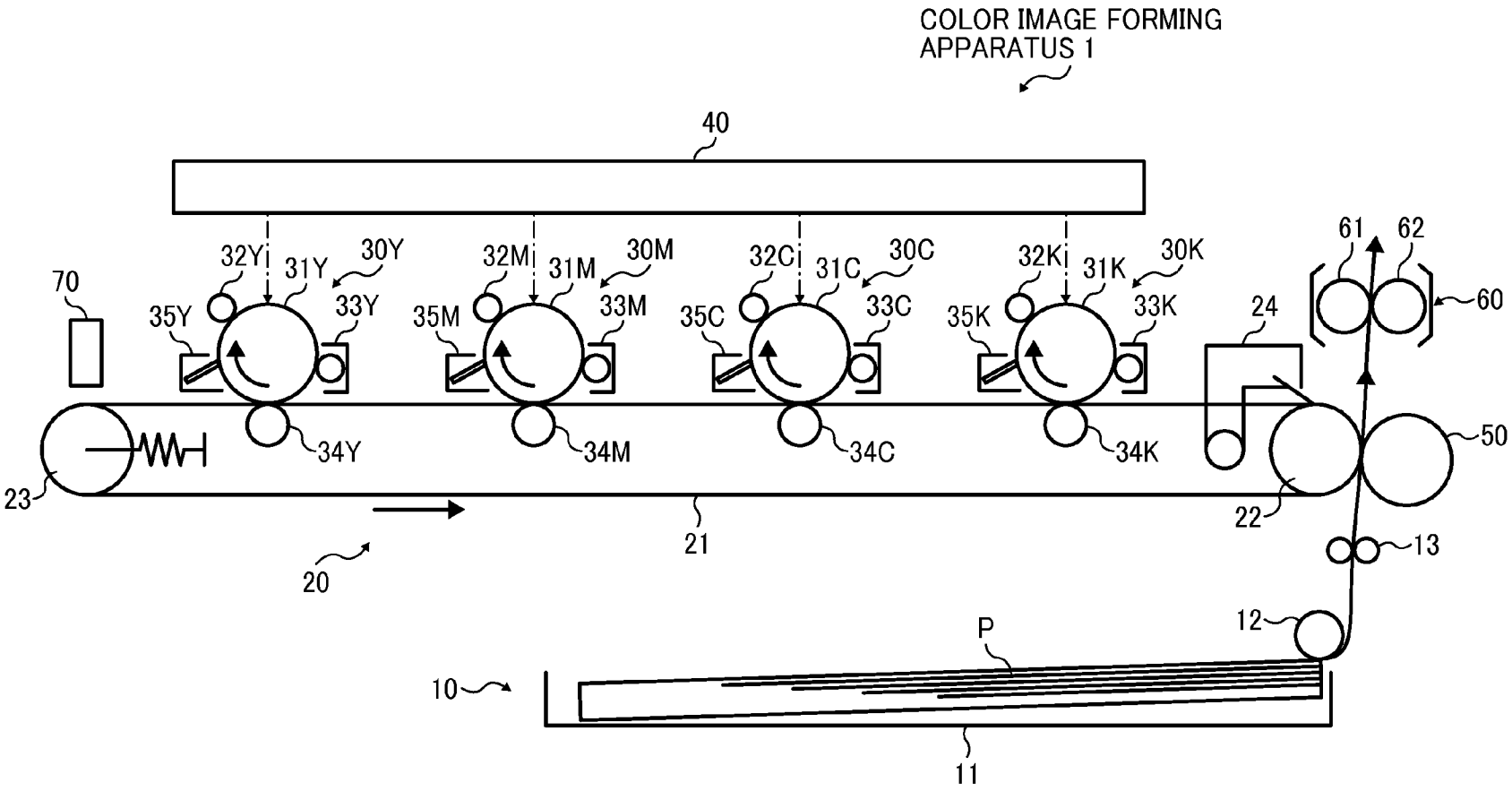
FIG. 1 is a schematic block diagram illustrating a configuration of a color image forming apparatus as an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In the technology known in the art described above, it is only to detect the curling of the endless belt and form the color adjustment pattern etc. keeping clear of the curling. Therefore, detecting precision of the curling is unclear, and amount how the curling affects detecting the color shift detection pattern and correcting color shift using the color shift detection pattern is also unclear. As a result, it is desired to detect the curling including its effect precisely.

In the following embodiment, an apparatus that detects the curling of the endless belt precisely is provided.

A curling detection apparatus in this embodiment is described below with reference to FIGS. 1 to 10. FIG. 1 is a schematic block diagram illustrating a configuration of a color image forming apparatus in this embodiment.

In FIG. 1, a color image forming apparatus (an image forming apparatus) 1 includes a paper feeding unit 10, a belt mechanism unit 20, image forming units (image formation units) for each color 30K, 30C, 30M, and 30Y, an exposure unit 40, a transferring unit 50, a fixing unit 60, and an image detector 70 etc. in a main body. Other than those units, the color image forming apparatus 1 includes a motor and a driving mechanism that conveys driving power to units driven by a motor (not shown in figures). The image forming units 30K, 30C, 30M and 30Y are laid out in the order of black (K), cyan (C), magenta (M), and yellow (Y) along with the belt mechanism unit 20.

The paper feeding unit 10 includes a paper feeding cassette 11, a paper feeding roller 12, and a registration roller 13 etc. The paper feeding unit 10 feeds paper P in the paper feeding cassette 11 separately one by one using the paper feeding roller 12 and a separation member (not shown in figures) and transfer the paper P to the registration roller 13. After adjusting timing of the paper P transferred by the paper feeding cassette 11, the registration roller 13 transfers the paper P between the belt mechanism unit 20 and the transferring unit 50 at predetermined timing.

The belt mechanism unit 20 includes an intermediate transfer belt 21, a driving roller 22, a tension roller 23, and a belt cleaning unit 24 etc., and the intermediate transfer belt (an endless belt) 21 is entrained around the driving roller 22 and the tension roller 23 as the rollers. The driving roller 22 drives in counterclockwise rotation by being driven by a driving mechanism (a conveying unit) such as a driving motor (not shown in figures) under the control of a controller 81 in FIG. 2 (described later). While the intermediate transfer belt 21 moves rotating through the image forming units for each color 30K, 30C, 30M, and 30Y, toner images for each color is transferred on the intermediate transfer belt 21 and superimposed sequentially by the image forming units for each color 30K, 30C, 30M, and 30Y The belt cleaning unit 24 removes toner remaining on the intermediate transfer belt 21 after transferring the toner image on the sheet P and cleans the intermediate transfer belt 21.

The driving mechanism described above functions as the conveying unit that conveys the intermediate transfer belt 21 by driving the driving roller 22 and the tension roller 23 as the rollers.

In the image forming units for each color 30K, 30C, 30M, and 30Y, the photoconductors 31K, 31C, 31M, and 31Y are disposed along with the conveying direction of the intermediate transfer belt 21 at a predetermined interval. In the image forming units 30K, 30C, 30M, and 30Y, charging units 32K, 32C, 32M, and 32Y, developing units 33K, 33C, 33M, and 33Y, transferring units 34K, 34C, 34M, and 34Y, cleaning units 35K, 35C, 35M, and 35Y, and electric charge removing units (not shown in figures) are disposed around each of the photoconductors 31K, 31C, 31M, and 31Y.

In the image forming units 30K, 30C, 30M, and 30Y, the photoconductors 31K, 31C, 31M, and 31Y driven by a driving mechanism (not shown in figures) in clockwise rotation in FIG. 1 are charged uniformly by the charging units 32K, 32C, 32M, and 32Y. In the image forming units 30K, 30C, 30M, and 30Y, the exposure unit 40 illuminates the photoconductors 31K, 31C, 31M, and 31Y with laser modulated using image data for each color to form an electrostatic latent image. In the image forming units 30K, 30C, 30M, and 30Y, the developing units 33K, 33C, 33M, and 33Y attach toner in each color to the photoconductors 31K, 31C, 31M, and 31Y on which the electrostatic latent images are formed to form toner images in each color. Subsequently, in the image forming units 30K, 30C, 30M, and 30Y, at a predetermined primary transfer timing, the transferring units 34K, 34C, 34M, and 34Y disposed backside of the intermediate transfer belt 21 apply transfer voltage to transfer toner images in each color on the photoconductors 31K, 31C, 31M, and 31Y to the intermediate transfer belt 21 superimposed sequentially.

After transferring the toner images, the cleaning units 35K, 35C, 35M, and 35Y clean toner remaining on the photoconductors 31K, 31C, 31M, and 31Y. After being processed by the electric charge removing unit, the photoconductors 31K, 31C, 31M, and 31Y are charged by the charging units 32K, 32C, 32M, and 32Y to be used in the next image forming operation.

In the color image forming apparatus 1, the intermediate transfer belt 21 on which the color toner image is formed by transferring and superimposing the toner image in colors, K, C, M, and Y sequentially by the image forming units 30K, 30C, 30M, and 30Y as described above is conveyed to the gap between the driving roller 22 and the transferring unit 50. On the other hand, in the color image forming apparatus 1, after transferring the paper P fed from the paper feeding cassette 11 to the registration roller 13 by the paper feeding unit 10, the paper P is conveyed to the transferring unit 50 by driving the registration roller 13 at the same time when the color toner image on the intermediate transfer belt 21 is conveyed to the transferring unit 50.

In the color image forming apparatus 1, transferring voltage is applied to the transferring unit at the same time when the color toner image on the intermediate transfer belt 21 is conveyed to a position facing to the transferring unit 50, and the color toner image on the intermediate transfer belt 21 is transferred to the paper P. For example, a transferring roller is used as the transferring unit 50.

In the color image forming apparatus 1, after finishing transferring the color toner image to the paper P, the paper P is conveyed to the fixing unit 60.

The fixing unit 60 includes a fusing roller 61, a pressure roller 62, and a pair of paper ejection rollers (not shown in figures) etc. The fusing roller 61 and the pressure roller 62 are pressed with each other at predetermined pressing force, and one roller is driven as the other roller drives. The fusing roller 61 is heated at predetermined fixing temperature by an internal heater.

In the fixing unit 60, the conveyed paper P on which the color toner image is transferred is heated and pressed by the fusing roller 61 and the pressure roller 62, the color toner image is fixed on the paper P, and the paper P is ejected on a paper output tray (not shown in figures).

In the color image forming apparatus 1, the belt cleaning unit 24 is disposed downstream of the driving roller 22 and upstream of the top image forming unit 30K in the moving direction of the intermediate transfer belt 21. After finishing transferring the toner image by the transferring unit 50, the belt cleaning unit 24 removes toner remaining on the intermediate transfer belt 21 and cleans the intermediate transfer belt 21. Subsequently, the next toner image is transferred.

Figure 2:
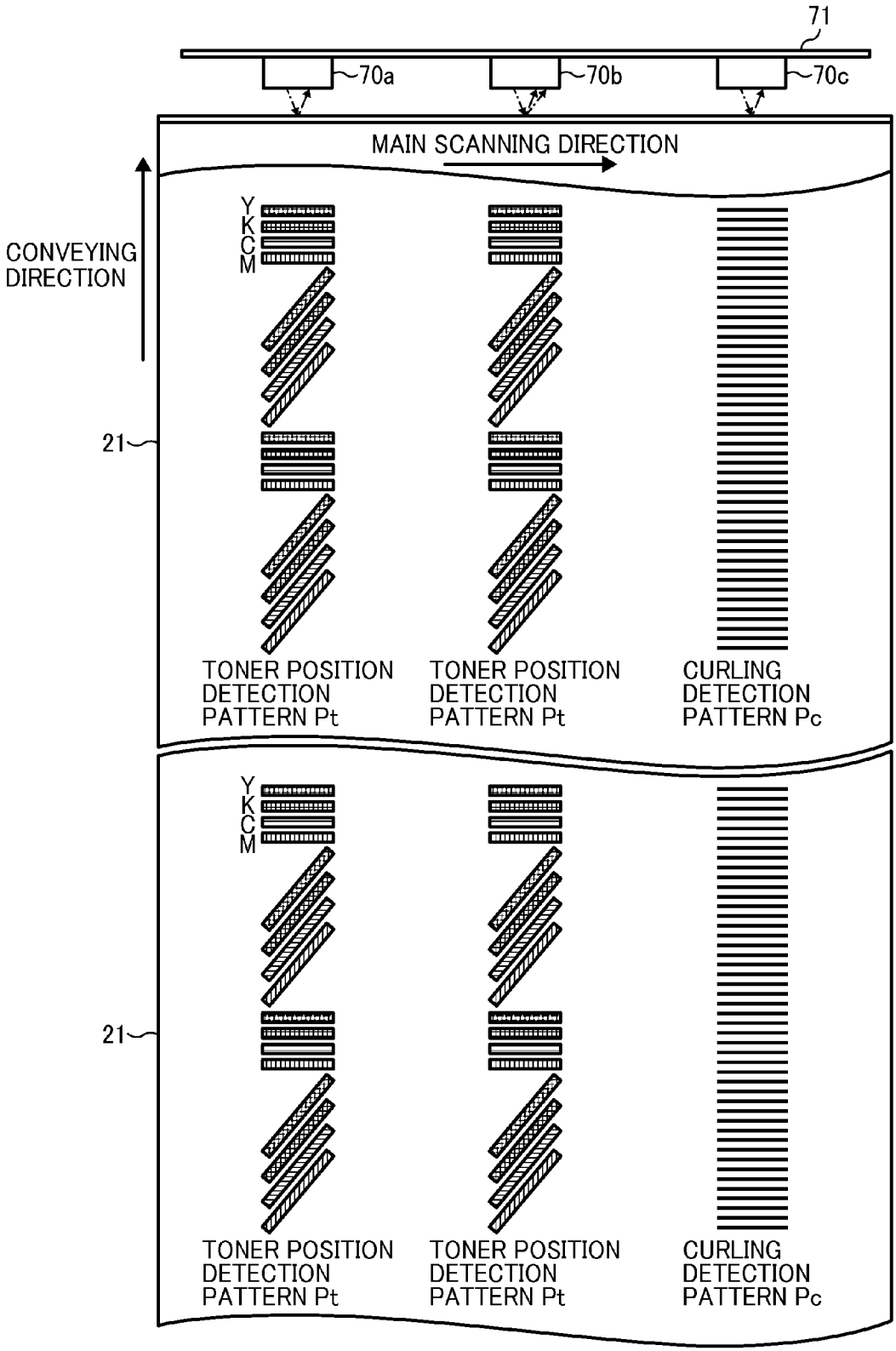
FIG. 2 is a diagram illustrating an intermediate transfer belt and an image detector as an embodiment of the present invention.

For example, as shown in FIG. 2, in the image detector 70, two position detectors 70*a* and 70*b* and a curling detector 70*c* are mounted on a mounter 71 in the main scanning direction (width direction) perpendicular to the conveying direction of the intermediate transfer belt 21. In the image detector 70, two position detectors 70*a* and 70*b* are disposed at one side end (left side end in FIG. 2) and center of the intermediate transfer belt 21, and the curling detector 70*c* is disposed at the other side end (right side end in FIG. 2) of the intermediate transfer belt 21.

In the color image forming apparatus 1, at the timing of correcting color shift, for example, a toner position detection pattern (image adjustment pattern) Pt and a curling detection pattern Pc shown in FIG. 2 are formed on the intermediate transfer belt 21 using the image forming unit 30K, 30C, 30M, and 30Y. Subsequently, in the color image forming apparatus 1, the position detectors 70*a* and 70*b* detect the toner position detection pattern Pt formed on the intermediate transfer belt 21, and the curling detector 70*c* detects the curling detection pattern Pc formed on the intermediate transfer belt 21.

For example, a reflection optical sensor that consists of a light emitting element such as a light emitting diode and a light-sensitive element such as a photo diode is used as the position detectors (image status scanning units) 70*a* and 70*b*. The position detectors 70*a* and 70*b* accept reflected light of detection light emitted into the intermediate transfer belt 21 from the light emitting element using the light-sensitive element and perform photoelectric conversion. An appropriate reflection optical sensor that can detect desired information to correct color shift appropriately from the toner position detection pattern Pt can be used as the position detectors 70*a* and 70*b*.

For example, a reflection optical sensor that consists of a light emitting element such as a light emitting diode and a light-sensitive element such as a photo diode is used as the curling detector (curling scanning units) 70*c*. The curling detector 70*c* accepts reflected light of detection light emitted into the intermediate transfer belt 21 from the light emitting element using the light-sensitive element and perform photoelectric conversion. An appropriate reflection optical sensor that can detect curling of the intermediate transfer belt 21 appropriately from the curling detection pattern Pc can be used as the curling detector 70*c*.

In the color image forming apparatus 1 in this embodiment, for example, as shown in FIG. 2, a pattern that consists of lines in the main scanning direction and oblique lines in black (K), cyan (C), magenta (M), and yellow (Y) is formed on the intermediate transfer belt 21 as the toner position detection pattern Pt by the image forming units 30K, 30C, 30M, and 30Y. In addition, in the color image forming apparatus 1 in this embodiment, a pattern that consists of lines having a predetermined length in the main scanning direction and with predetermined narrow width and a predetermined narrow interval in parallel with the sub-scanning direction is formed on the intermediate transfer belt 21 as the curling detection pattern Pc. Since the purpose of forming the curling detection pattern Pc is to detect curling status of the intermediate transfer belt 21, it is desired to form the curling detection pattern Pc at an equal interval. Therefore, it is desired to form the curling detection pattern Pc in one color using any one of the image forming units 30K, 30C, 30M, and 30Y. In addition, it is desired to form the curling detection pattern Pc in black using the image forming unit 30K to reduce effect of diffuse light and detect a position with high precision in the detection by the curling detector 70*c*.

Figure 3:
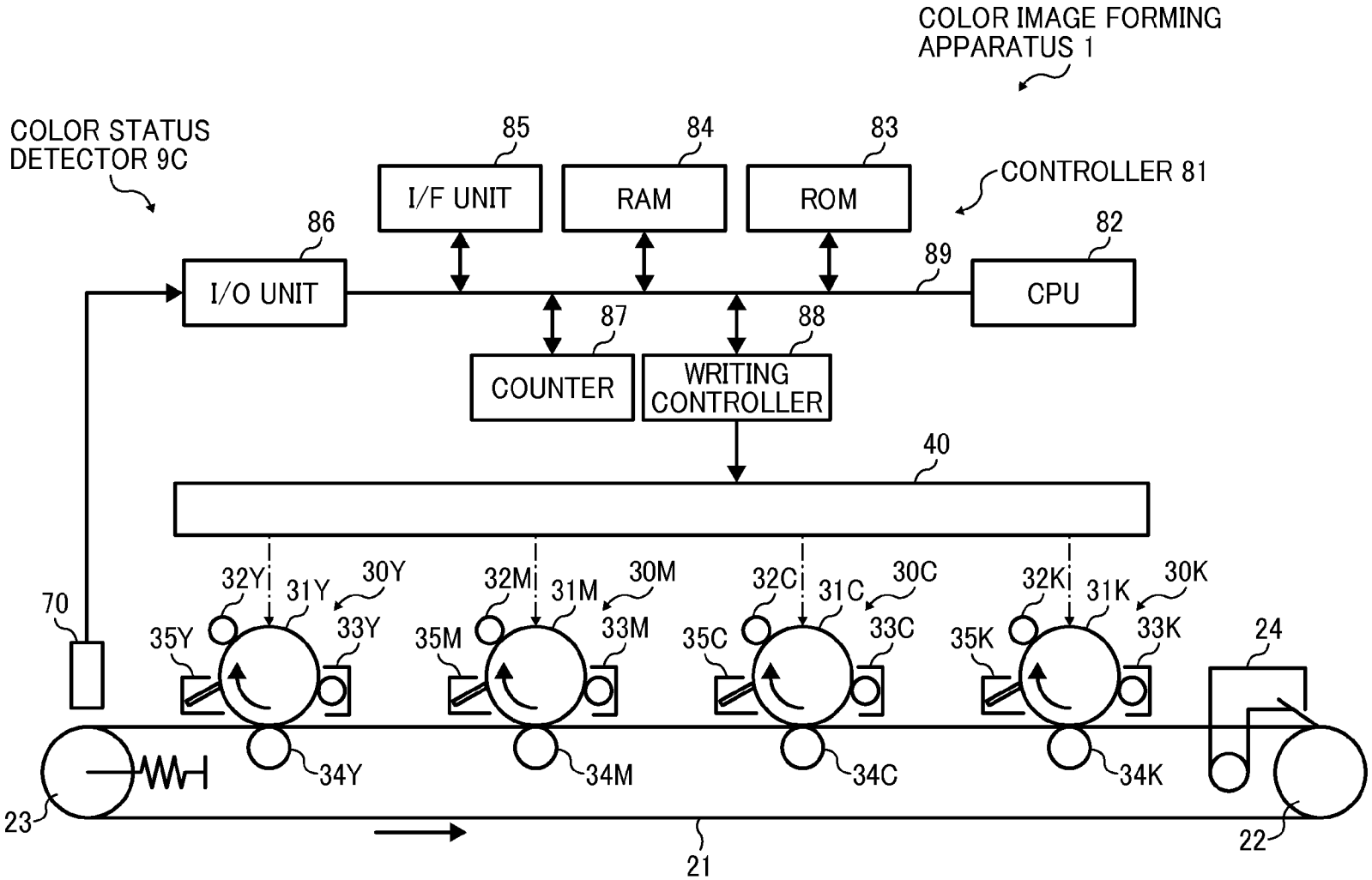
FIG. 3 is a diagram illustrating a schematic configuration of the color image forming apparatus and a block configuration of the controller as an embodiment of the present invention.

As shown in FIG. 3, the color image forming apparatus 1 includes a controller 81 and an operational display unit etc. (not shown in figures). The controller 81 includes a Central Processing Unit (CPU) 82, a Read Only Memory (ROM) 83, a Random Access Memory 84, an interface (I/F) unit 85, an Input/Output (I/O) unit 86, a counter 87, and a writing controller 88 etc. In the controller 81, units are connected with each other via a bus 89.

The ROM 83 stores an operating system of the color image forming apparatus 1, a curling status detecting program, an image adjusting program, and fundamental data used in this embodiment.

Data such as image data for each page expanded in a work memory of the CPU 82 is written in and read from the RAM 84 under the control of the CPU 82.

Based on the program stored in the ROM 83, the CPU 82 controls the whole color image forming unit 1 using the RAM 84 as the work memory, performs basic processes as the color image forming apparatus 1, and performs the curling status detection process and the image adjustment process in this embodiment. Based on image data in red (R), green (G), and blue (B), the CPU 82 generates drawing data in black (K), cyan (C), magenta (M), and yellow (Y) using the RAM 84 and expands the generated drawing data for one page into the RAM 84. The CPU 82 transfers the drawing data expanded into the RAM 84 to the writing controller 88 and controls the timing of drawing.

The I/F unit 85 such as a communication interface etc. is connected to an external apparatus such as a computer via a network such as Local Area Network or a dedicated line. The I/F unit 85 communicates with the external apparatus, receives image data etc. from the external apparatus, and transfers a processing result of the image data to the external apparatus.

The I/O unit 86 communicates with the controller 81, various sensors, and an actuator etc. and receives/transfers a signal from/to the sensors and the actuator etc. Especially, the I/O unit 86 is connected to the position detector 70, and the I/O unit 86 receives a detection signal from the position detector 70 and passes it to the CPU 82.

The counter 87 operates under the control of the CPU 82, counts the number of the toner position detection pattern Pt and the curling detection pattern Pc formed on the intermediate transfer belt 21, and counts time between the toner position detection patterns Pt (hereinafter referred to as "toner position pattern interval time" appropriately).

Based on the drawing data in K, C, M, and Y generated from the image data in R, G, and B to be printed, the writing controller 88 controls driving of the exposure unit 40 to emit laser corresponding to the image to be printed. In addition, the writing controller 88 receives image data of the toner position detection pattern Pt and the curling detection pattern Pc stored in the ROM 83 preliminarily from the CPU 82 and instructs to emit laser corresponding to images of the toner position detection pattern Pt and the curling detection pattern Pc.

The controller 81 described above (especially the CPU 82, the ROM 83, the RAM 84, the I/O unit 86, the counter 87, and the writing controller 88) functions as a pattern image forming control unit that instructs the image forming units 30K, 30C, 30M, and 30Y to form lines of the curling detection pattern Pc at predetermined intervals in the conveying direction of the intermediate transfer belt 21 as the endless belt and a predetermined angle against the conveying direction at a predetermined timing.

In addition, the controller 81 functions as a detection unit that detects curling of the intermediate transfer belt 21 based on the interval of the curling detection pattern Pc scanned by the curling detector 70*c* as the curling status scanning unit.

Furthermore, the controller 81, the driving roller 22, the tension roller 23, the intermediate transfer belt 21, the driving motor (not shown in figures) that drives the driving roller 22, the image forming units 30K, 30C, 30M, and 30Y, and the curling detector 70*c* function as a curling status detector (a curling status detecting unit) that detects curling of the intermediate transfer belt 21 based on the interval of the curling detection pattern Pc formed on the intermediate transfer belt 21.

The controller 81 (especially the CPU 82, the ROM 83, the RAM 84, the I/O unit 86, the counter 87, and the writing controller 88) functions as an adjustment unit that adjust the image formation by the image forming units 30K, 30C, 30M, and 30Y based on the scanning result of the toner position detection pattern (image adjustment pattern) Pt by the position detectors 70*a* and 70*b* as the image status scanning units.

Furthermore, the controller 81 (especially the CPU 82, the ROM 83, the RAM 84, the I/O unit 86, the counter 87, and the writing controller 88) functions as an image formation adjusting control unit that controls adjustment of image formation by determining the toner position detection pattern Pt used for the adjustment of the image formation by the controller 81 as the adjustment unit described above in accordance with the curling status of the intermediate transfer belt 21 detected by the controller 81 as the detection unit described above.

The color image forming apparatus 1 in this embodiment includes a curling detector that performs a curling detecting method that detects curling of the endless belt (described later) and an image adjusting method that process an image appropriately without effect of the curling by reading and installing a curling detection program that performs a curling detecting method and an image adjustment program that performs an image adjustment method in this embodiment stored in a computer-readable recording medium such as a ROM, Electrically Erasable and Programmable Read Only Memory (EEPROM), EPROM, flash memory, flexible disk, Compact Disc Read Only Memory (CD-ROM), Compact Disc Rewritable (CD-RW), Digital versatile Disk (DVD), Secure Digital (SD) card, and Magneto-Optical (MO) Disc in the ROM 83 etc. The curling detection program and the image adjustment program are computer-executable programs written in legacy programming languages and object-oriented programming languages such as assembler, C, C++, C#, and Java etc., and the power supply control program can be distributed by storing in the recording medium described above.

Next, workings in this embodiment are described below. The color image forming apparatus 1 in this embodiment detects the curling of the intermediate transfer belt 21 as the endless belt precisely.

That is, in the color image forming apparatus 1, the intermediate transfer belt 21 as the endless belt is entrained around the driving roller 22 and the tension roller 23. For example, if the intermediate transfer belt 21 is not driven and stays at the same position for a certain period of time, the intermediate transfer belt 21 conforms to the curvature of the driving roller 22 and the tension roller 23.

The color image forming apparatus 1 superimposes images in K, C, M, and Y on the intermediate transfer belt 21 sequentially using the image forming units 30K, 30C, 30M, and 30Y to form a color image. As a result, if timing of forming an image by the image forming units 30K, 30C, 30M, and 30Y does not correspond or density between image data varies, position shift and density difference of the color image could occur, and that degrades the image quality.

To cope with this issue, in the color image forming apparatus 1, a toner position detection pattern Pt is formed on the intermediate transfer belt 21 at predetermined timing, and the toner position detection pattern Pt is detected by position detectors 70*a* and 70*b* to perform an image adjustment process that corrects position shift and density.

If the intermediate transfer belt 21 gets curled detection error of the toner position detection pattern Pt by the position detectors 70*a* and 70*b* affects error of adjusting images considerably depending on the curling.

That is, if the intermediate transfer belt 21 gets curled, an angle between the intermediate transfer belt 21 and the position detectors 70*a* and 70*b* parallel under ordinarily circumstances changes. For example, if surface of the intermediate transfer belt 21 where the toner position detection pattern Pt does not exist is illuminated with detection light from the light emitting element of the position detectors 70*a* and 70*b*, not all reflected light does not enter into the light-sensitive element. As a result, in case of scanning the curling of the intermediate transfer belt 21, output voltage of the position detectors 70*a* and 70*b* gets low. By contrast, in case of scanning the toner position detection pattern Pt at status and a position without any curling of the intermediate transfer belt 21, light is absorbed by toner of the toner position detection pattern Pt, and output voltage of the position detectors 70*a* and 70*b* gets low. As a result, it is possible not to distinguish the toner position detection pattern Pt with the curling, and it is possible to detect the toner position detection pattern Pt wrongly and occur error.

To cope with this issue, in the color image forming apparatus 1 in this embodiment, it is possible to detect the curling of the intermediate transfer belt 21 precisely, and depending on the curling status, the toner position detection pattern Pt on the curling is excluded from the toner position detection pattern Pt used for the image adjustment process.

Figure 4:
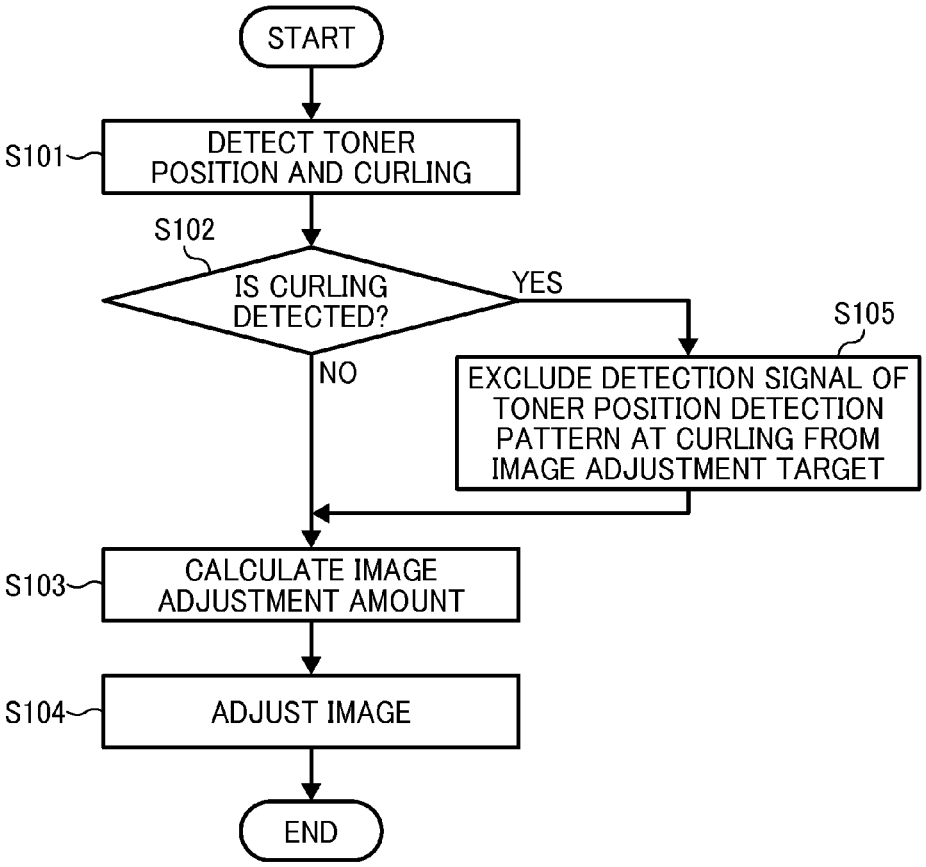
FIG. 4 is a flowchart illustrating an image adjustment process including a curling detection process as an embodiment of the present invention.

In addition, in the color image forming apparatus 1, as shown in FIG. 4, the image adjustment process along with the curling detection process is performed at the timing of adjusting images under the control of the CPU 82. That is, at the timing of adjusting images, first, the CPU 82 detects the toner position and the curling in S101. In S101, first, the CPU 82 reads the toner position detection pattern Pt and the curling detection pattern Pc from the ROM 83. As shown in FIG. 2, the CPU 82 controls the image forming units 30K, 30C, 30M, and 30Y, the writing controller 88, the exposure unit 40, and other motors to form images of the toner position detection pattern Pt and the curling detection pattern Pc on the intermediate transfer belt 21. As shown in FIG. 2, the image of the toner position detection pattern Pt consists of patterns in K, C, M, and Y, and the image of the curling detection pattern Pc consists of patterns in K only. Subsequently, the CPU 82 scans the images of the toner position detection pattern Pt and the curling detection pattern Pc formed on the intermediate transfer belt 21 using the position detector 70 and receives the scanning result via the I/O unit 86. More specifically, the position detectors 70*a* and 70*b* scans the image of the toner position detection pattern Pt and outputs it to the CPU 82, and the curling detector 70*c* scans the image of the curling detection pattern Pc and outputs it to the CPU 82.

Next, the CPU 82 determines whether or not there is the curling of the intermediate transfer belt 21 more than predetermined amount based on the scanning result of the curling detection pattern Pc by the curling detector 70*c* in S102.

Figure 5:
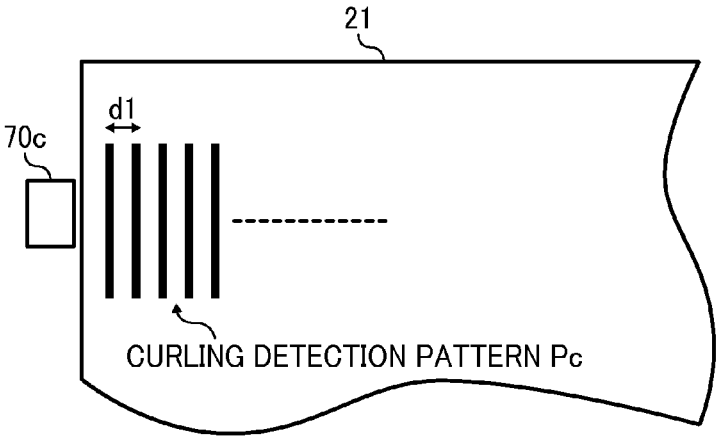
FIG. 5 is a diagram illustrating a process of detecting a curl detection pattern as an embodiment of the present invention.
Figure 6:
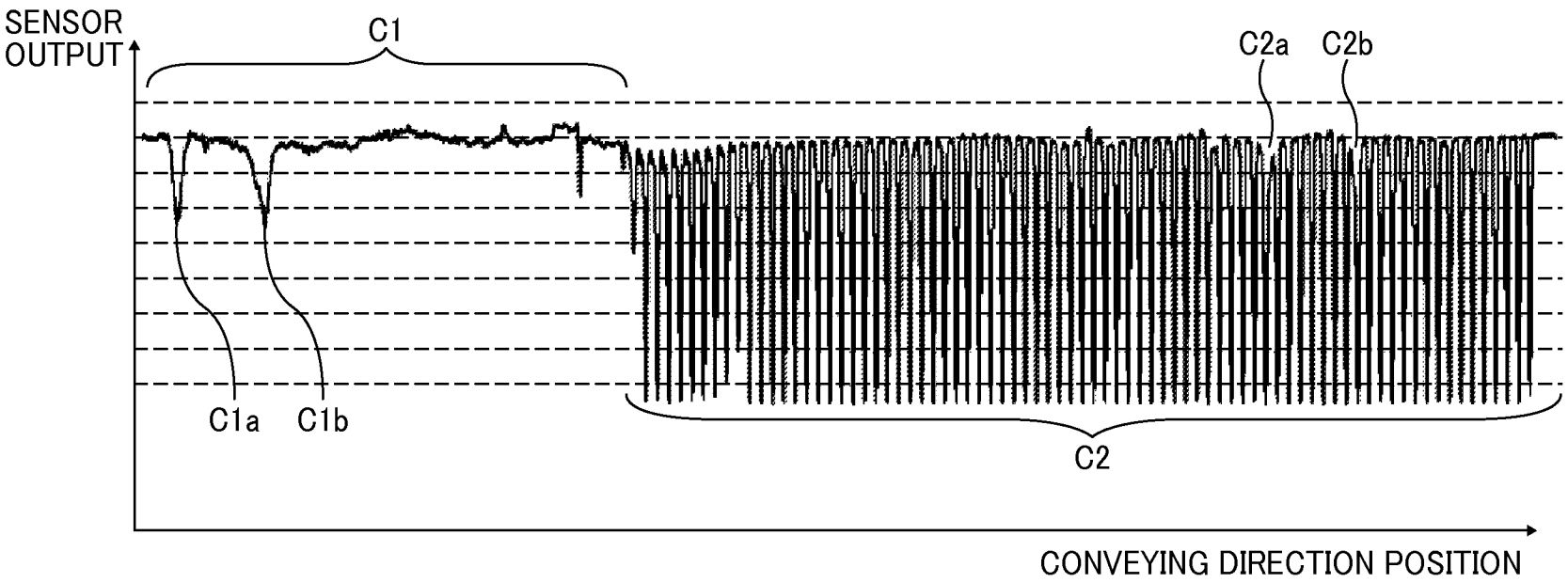
FIG. 6 is a diagram illustrating a relationship between curling of the intermediate transfer belt and an output by a position detector as an embodiment of the present invention.

That is, as shown in FIG. 5, in the curling detection pattern Pc, lines having a predetermined length in the main scanning direction and a predetermined narrow width and a predetermined narrow interval d1 in parallel with the sub-scanning direction are formed on the intermediate transfer belt 21 at even intervals, and the curling detection pattern Pc is formed in one color, black (K), by the image forming unit 30K for black (K). The curling detector 70*c* illuminates the intermediate transfer belt 21 where the curling detection pattern Pc is formed with detection light using the light emitting element, detects the reflected light by receiving the reflected light using the light-sensitive element, and outputs a detection signal (sensor signal) shown in FIG. 6 to the CPU 82. In FIG. 6, a region C1 indicates the detection signal by the curling detector 70*c* in the area on the intermediate transfer belt 21 where the curling detection pattern Pc is not formed, and a region C2 indicates the detection signal by the curling detector 70*c* in the area on the intermediate transfer belt 21 where the curling detection pattern Pc is formed. Signals C1*a* and C1*b* are detection signals by the curling detector 70*c* when the curling in the region C1 is scanned, and signals C2*a* and C2*b* are detection signals by the curling detector 70*c* when the curling in the region C2 is scanned just like the signals C1*a* and C1*b*. That is, in the signals C1*a* and C1*b*, since the curling detection pattern Pc is not formed, the signal value of the detection signal does not get lower because the detection light from the curling detector 70*c* is not absorbed. However, the signal value gets lower because the detection light is diffused by the curling of the intermediate transfer belt 21. In the signals C2*a* and C2*b*, there is disturbance as the signal gets lower while the signal value of the detection signal gets lower for each of the curling detection patterns Pc since the detection light is absorbed by the curling detection pattern Pc.

Figure 7B:
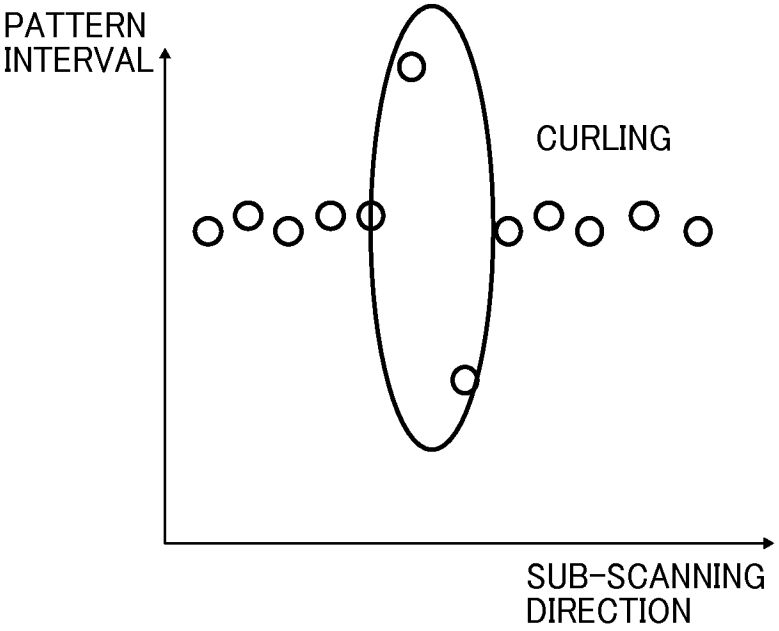
FIGS. 7A and 7B are diagrams illustrating a status of changing intervals between curling detection patterns depending on with or without curling as an embodiment of the present invention.
Figure 7A:
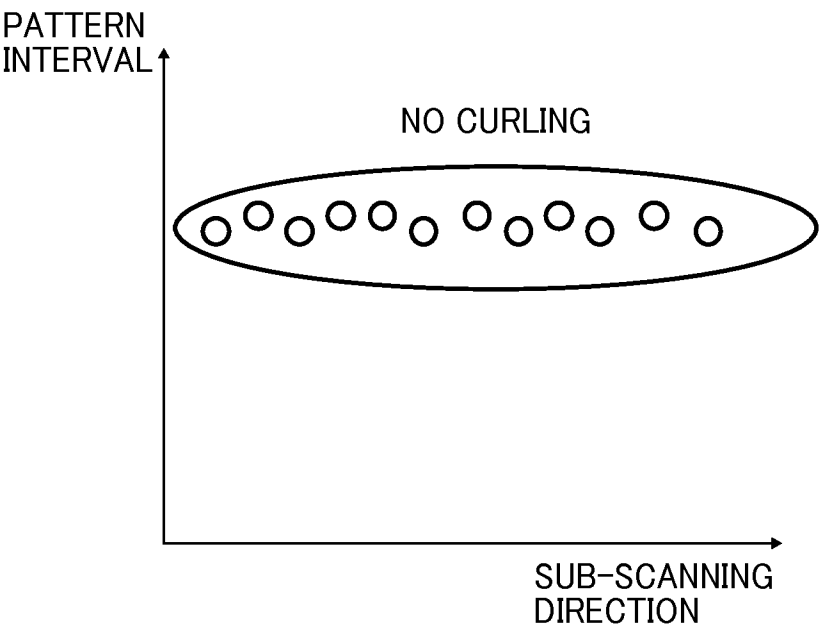

Since the curling detection pattern Pc consists of lines at the predetermined intervals in black (K) only, the pattern intervals between the curling detection pattern Pc detected by the detection signal of the curling detector 70*c* become constant substantially if there is no curling of the intermediate transfer belt 21 as shown in FIG. 7A. However, if there is the curling of the intermediate transfer belt 21, as shown in FIG. 7B with large circle indicating "there is curling", the pattern intervals between the curling detection pattern Pc detected by the detection signal of the curling detector 70*c* varies at the curling. That is, in FIG. 7B, the patter intervals indicated by the detection signal are constant substantially while the curling does not exist. However, difference from the previous pattern becomes large due to the curling. Subsequently, the pattern intervals become smaller. After that, at the position where the curling does not exist, the pattern intervals become constant substantially as before. The amount of the curling (the curling status) can be calculated using differences between positions of patterns in the detection signal or difference between patterns.

It is preferable that the pattern intervals between the curling detection pattern Pc are suitable for determining the amount of curling. Furthermore, since the length of the curling in the conveying direction depends on diameters of the driving roller 22 and the tension roller 23, it is preferable that the intervals between the curling detection pattern Pc correspond to the diameters of the driving roller 22 and the tension roller 23.

Therefore, in the color image forming apparatus 1, data associated curling status with the pattern intervals that indicates the amount of the curling of the intermediate transfer belt 21 is calculated preliminary using a waveform of the detection signal by the curling detector 70*c* shown in FIG. 6 by experiment etc. and is stored in the ROM 83 etc. Subsequently, in the image adjustment process, based on the signal pattern of the detection signal from the curling detector 70*c*, the CPU 82 determines whether or not the curling exists and calculates the amount of the curling with reference to the data associated the curling status with the pattern intervals stored in the ROM 83 and determines whether or not there is the curling exceeds a predetermined amount on the intermediate transfer belt 21 in S102.

Alternatively, it is possible to determine whether or not the curling exceeds the predetermined amount exists by checking the pattern intervals between the curling detection pattern Pc sequentially using deviation from a rated value.

In this embodiment, the amount of the curling of the intermediate transfer belt 21 is determined using the difference between positions of the adjacent curling detection patterns Pc. However, the amount of the curling can be determined by calculating difference between patterns apart more than one pattern. Furthermore, it is preferable that the pattern intervals between the curling detection patterns Pc to be compared reflect the effect of the curling of the intermediate transfer belt 21 appropriately. In addition, since the length of the curling depends on the diameters of the driving roller 22 and the tension roller 23 that tensions the intermediate transfer belt 21, the length of the curling is determined based on the value calculated from the diameters of the driving roller 22 and the tension roller 23. In this case, for example, it is possible to configure the length of the curling by calculating intervals that indicates the effect of the curling of the intermediate transfer belt 21 appropriately using the detection waveform of the curling detection pattern Pc from the curling detector 70*c* as shown in FIG. 6.

Next, if the curling exceeds the predetermined amount does not exist (NO in S102), the CPU 82 calculates image adjustment amount based on the detection signal of the toner position detection pattern Pt from the position detectors 70*a* and 70*b* in S103. Since the calculation of the image adjustment amount described above is similar to the calculation in a normal color shift adjustment process and a density adjustment process, the detailed description for the calculation is omitted.

After calculating the image adjustment amount, the CPU 82 performs the image adjustment process that adjusts exposure timing and density for each color of the exposure unit 60 by the writing controller 88 based on the image adjustment amount described above to adjust the color shift and density difference, and the image adjustment process is finished in S104.

If the curling exceeds the predetermined amount exists (YES in S102), the CPU 82 excludes the detection signal of the toner position detection pattern Pt at the curling from signals to be performed the image adjustment process in S105.

Figure 8:
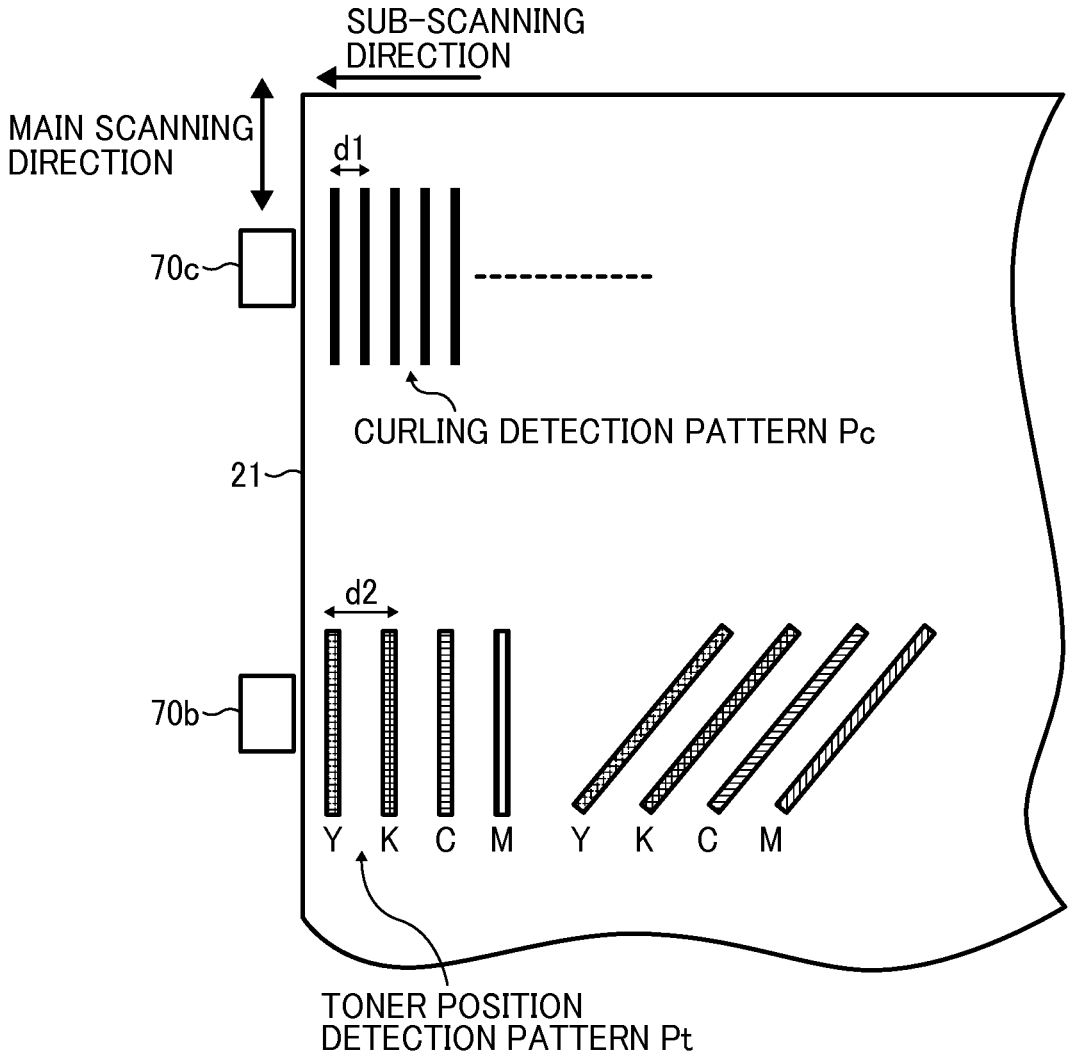
FIG. 8 is a diagram illustrating relative positions of the curling detection pattern and the toner position detection pattern as an embodiment of the present invention.

As shown in FIGS. 2 and 8, the curling detection pattern Pc and the toner position detection pattern Pt associated with each other in the main scanning direction are formed on the intermediate transfer belt 21. As a result, based on the detection signal of the curling detection pattern Pc, the CPU 82 specifies a position of the toner position detection pattern Pt corresponding to the signal of the curling detection pattern Pc that indicates that curling more than the predetermined amount exists (i.e., the detection signal of the position detectors 70*a* and 70*b* that detects the toner position detection pattern Pt) and excludes the detection signal from the signals to be performed the image adjustment process.

As shown in FIG. 8, in the curling detection pattern Pc and the toner position detection pattern Pt, an interval d1 of the curling detection pattern Pc in the sub-scanning direction is equal to or smaller than an interval d2 of the toner position detection pattern Pt.

Figure 9:
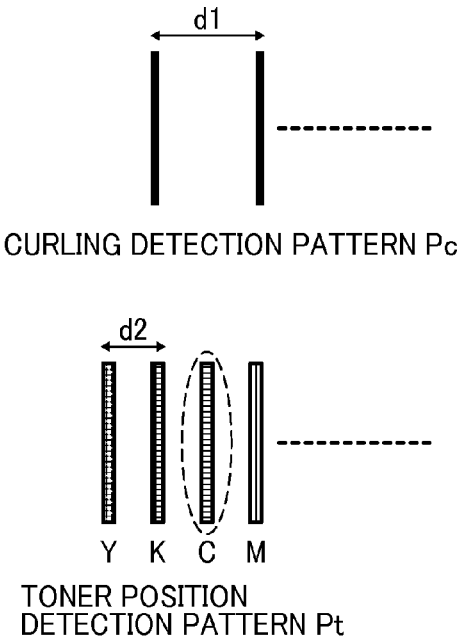
FIG. 9 is a diagram illustrating a state in which intervals of the curling detection patterns are longer than intervals of the toner position detection patterns as an embodiment of the present invention.

That is, as shown in FIG. 9, if the curling detection pattern Pc has wider interval than the toner position detection pattern Pt (i.e., d1>d2), it is possible that it is difficult to determine whether or not the curling affects the interval of the toner position detection pattern Pt. For example, in FIG. 9, since the toner position detection pattern Pt surrounded by dashed lines is within the interval of the curling detection pattern Pc, it is difficult to determine whether or not the curling affects even if the curling is detected in the curling detection pattern Pc.

It is limited to narrow the pattern interval dl of the curling detection pattern Pc depending on performance of the image forming units 30K to 30Y and the curling detector 70*c*. For example, even if the pattern interval d1 is formed at the performance limit of the image forming units 30K to 30Y, depending on the performance of the curling detector 70*c*, peaks of the output waveform of the curling detector 70*c* in FIG. 6 are all connected, and it is difficult to detect the curling and the curling position appropriately.

Figure 10:
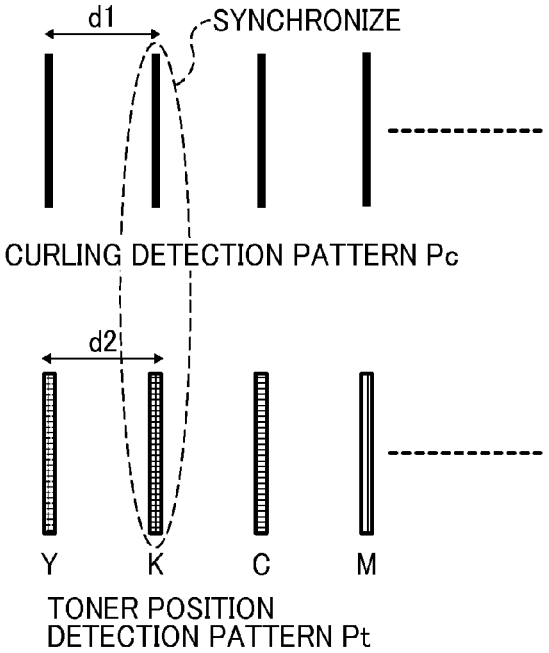
FIG. 10 is a diagram illustrating a state in which intervals of the curling detection patterns are the same as intervals of the toner position detection patterns as an embodiment of the present invention.

Consequently, it is possible to narrow the pattern interval dl of the curling detection pattern Pc in accordance with the performance of the image forming units 30K to 30Y and the curling detector 70*c*. Furthermore, just like equalizing the pattern interval d1 in the curling detection pattern Pc with the pattern interval d2 in the toner position detection pattern Pt, as shown in FIG. 10, the timing of same-color pattern formation is also synchronized. In this embodiment, since the curling detection pattern Pc is formed in black (K), the curling detection pattern Pc in K is formed in synchronization with the toner position detection pattern Pt.

As a result, it is possible to detect the pattern intervals between the curling detection pattern Pc appropriately, and it is possible to detect whether or not curling more than the predetermined amount exists based on the detected pattern interval of the curling detection pattern Pc. In addition, if curling exists, it is possible to specify the toner position detection pattern Pt corresponding to the position where the curling exists appropriately and exclude it from signals to be performed the image adjustment process. Consequently, it is possible to enhance the adjustment precision in the image adjustment process.

Figure 11:
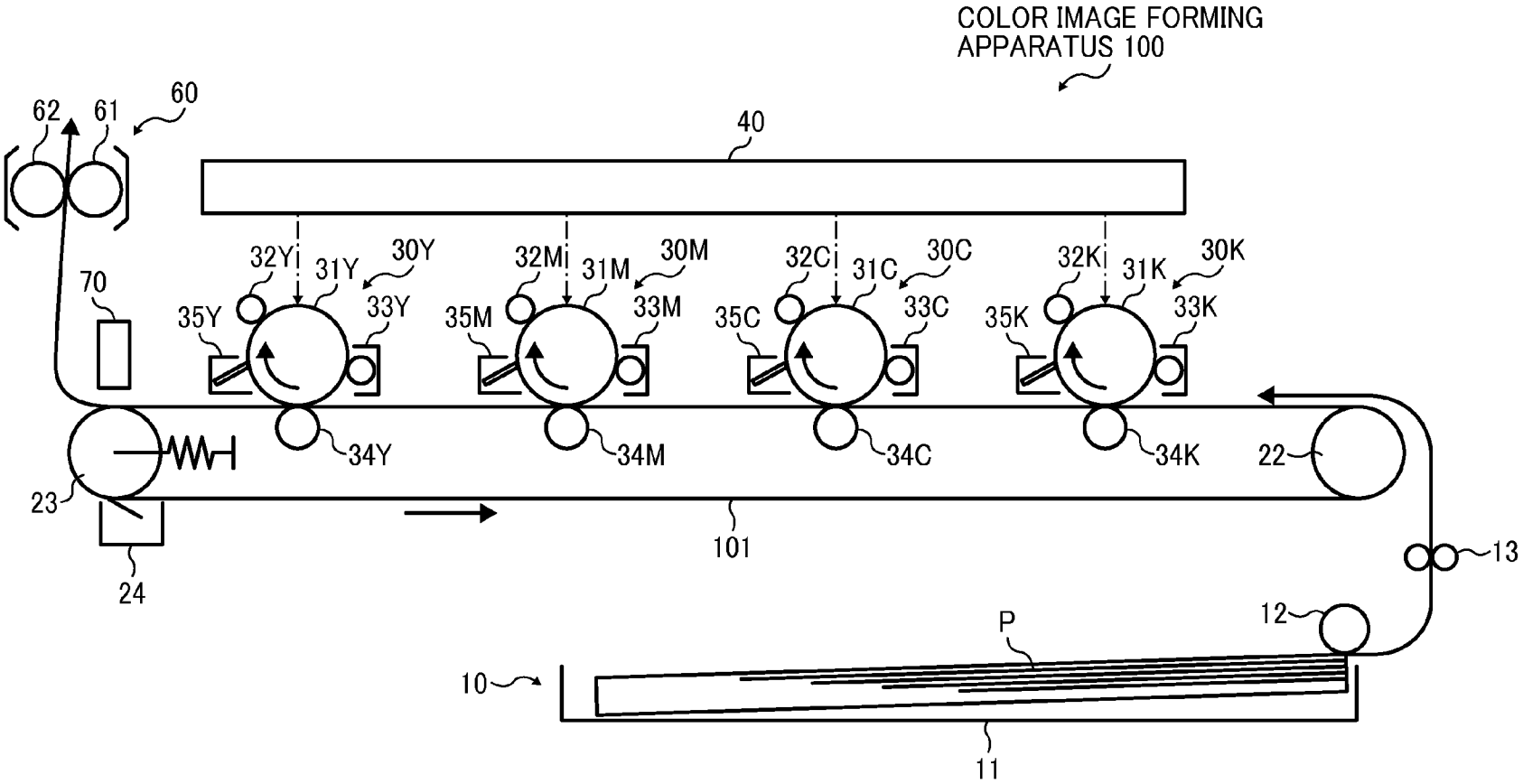
FIG. 11 is a schematic block diagram illustrating a configuration of a color image forming apparatus including the conveyance belt as an embodiment of the present invention.

In the above description, the case applied to the color image forming apparatus 1 that uses the intermediate transfer belt 21 as the endless belt is described. However, the image forming apparatus is not limited to the case described above. For example, similar to the color image forming apparatus 100 shown in FIG. 11, the image forming apparatus can use a conveyance belt 101 as the endless belt. In FIG. 11, same symbols are assigned to configuration units similar to FIG. 1 even if they are located at different positions, and descriptions for those configuration units are omitted.

In FIG. 11, in the color image forming apparatus 100, the conveyance belt 101 as the endless belt is entrained around the driving roller 22 and the tension roller 23, and the conveyance belt 101 is rotated counterclockwise by driving the driving roller 22 by a driving mechanism. In the color image forming apparatus 100, the image forming units 30K, 30C, 30M, and 30Y are disposed along with the conveyance belt 101 in the conveying direction of the conveyance belt 101 sequentially, and the belt cleaning unit 24 is disposed under the tension roller 23. In the color image forming apparatus 100, paper P fed from the paper feeding unit 10 is conveyed from the registration roller 13 to the conveyance belt 101, and the paper P absorbed to the conveyance belt 101 using magnetic adsorption etc. is conveyed by the conveyance belt 101 through the image forming units 30K, 30C, 30M, and 30Y sequentially. Each of the image forming units 30K, 30C, 30M, and 30Y superimposes and transfers the toner image in each color on the paper P conveyed on the conveyance belt 101 to form the color toner image. In the color image forming apparatus 100, the paper P on which the toner image has been formed is separated from the conveyance belt 101 using a separation claw (not shown in figures) to be transferred to the fixing unit, and the toner image is fixed by the fixing unit 60.

In the color image forming apparatus 100, the CPU 82 controls the image forming units 30K, 30C, 30M, and 30Y and the exposure unit 40 etc. to form the toner position detection pattern Pt and the curling detection pattern Pc on the conveyance belt 101 directly or the paper P conveyed by the conveyance belt 101 at the predetermined timing of adjusting images. In the color image forming apparatus 100, these toner position detection pattern Pt and the curling detection pattern Pc are detected using the position detectors 70*a*, 70*b*, and 70*c* disposed downstream of the image forming unit 30Y. In the color image forming apparatus 100, based on the detection result of the curling detection pattern Pc by the curling detector 70*c*, the curling status of the conveyance belt 101 is determined, and the image adjustment process is performed based on the scanning result of the toner position detection patterns Pt excluding the toner position detection pattern Pt at the part where the curling more than the predetermined amount exists among the toner position detection patterns Pt detected by the position detectors 70*a* and 70*b*.

As described above, in the color image forming apparatuses 1 and 100 in this embodiment, the curling detector includes the endless belts such as the intermediate transfer belt 21 and the conveyance belt 101 entrained around at least two rollers (the driving roller 22 and the tension roller 23), the conveyance mechanism (conveyance unit) that conveys the endless belts by driving the driving roller 22 and the tension roller 23, the image forming units 30K, 30C, 30M, and 30Y that forms the image by transferring the toner image to the surface of the conveyed endless belt directly or the paper (recording medium) P on the endless belt, the controller (the pattern image forming controller) 81 that instructs the image forming units 30K, 30C, 30M, and 30Y to form lines of the curling detection pattern Pc with the predetermined interval in the conveying direction of the endless belt and the predetermined angle against the conveying direction, the curling detector 70*c* that scans the curling detection pattern Pc, and the controller (detection unit) 81 that detects curling of the endless belt based on the pattern intervals between the curling detection pattern Pc scanned by the curling detector 70*c*.

Consequently, it is possible to detect the curling of the endless belt based on the scanning result of the pattern interval of the curling detection pattern Pc formed on the endless belt such as the intermediate transfer belt 21 and the conveyance belt 101 (including the paper P) precisely.

In the color image forming apparatuses 1 and 100 in this embodiment, lines of the curling detection pattern Pc with predetermined length in the direction perpendicular to the conveying direction is formed using black toner.

Consequently, it is possible to reduce effect of diffused light of the detection light from the curling detector 70*c*, and it is possible to enhance detecting precision of the curling detection pattern Pc by the curling detector 70*c* (i.e., curling of the endless belt such as the intermediate transfer belt 21 and the conveyance belt 101).

The color image forming apparatuses 1 and 100 in this embodiment includes the endless belts such as the intermediate transfer belt 21 and the conveyance belt 101 entrained around at least two rollers (the driving roller 22 and the tension roller 23), the conveyance mechanism (conveyance unit) that conveys the endless belts by driving the driving roller 22 and the tension roller 23, the image forming units 30K, 30C, 30M, and 30Y that forms the image by transferring the toner image to the surface of the conveyed endless belt directly or the paper (recording medium) P on the endless belt, the controller (the pattern image forming controller) 81 that instructs the image forming units 30K, 30C, 30M, and 30Y to form lines of the curling detection pattern Pc with the predetermined interval in the conveying direction of the endless belt and the predetermined angle against the conveying direction and the toner position detection pattern Pt laid out in the direction perpendicular to the curling detection pattern Pc with predetermined angle against the perpendicular direction, the curling detector 70*c* that scans the curling detection pattern Pc, the position detectors (image status scanning units) 70*a* and 70*b* that scans the toner position detection pattern Pt, the controller (adjustment unit) 81 that adjusts forming an image by the image forming units 30Y, 30C, 30M, and 30Y based on the scanning result of the toner position detection pattern Pt by the position detectors 70*a* and 70*b*, the controller (detection unit) 81 that detects curling of the endless belt based on the pattern intervals between the curling detection pattern Pc scanned by the curling detector 70*c*, and the controller (image formation adjustment controller) 81 that controls image formation adjustment by determining the toner position detection pattern Pt used for the image formation adjustment by the controller 81 as the adjustment unit in accordance with the curling of the endless belt detected by the controller 81 as the detection unit.

Consequently, it is possible to determine the toner position detection pattern Pt used for the image formation adjustment by the controller 81 in accordance with the curling of the endless belt detected precisely based on the pattern interval of the curling detection pattern Pc. As a result, it is possible to enhance the precision of the image formation adjustment.

In the color image forming apparatuses 1 and 100 in this embodiment, the controller 81 as the image formation adjustment unit instructs the controller 81 as the adjustment unit to perform the image formation adjustment based on the toner position detection patterns Pt excluding the toner position detection pattern Pt at the position corresponding to the curling detection pattern Pc in the perpendicular direction on the area where the curling detected by the controller 81 as the detection unit more than the predetermined amount exists.

Consequently, it is possible to perform the image formation adjustment such as adjusting color shift and density etc. using the toner position detection pattern Pt excluding the toner position detection pattern Pt on the curling of the endless belt detected precisely, and it is possible to enhance the precision of adjusting the image formation much more.

Furthermore, in the color image forming apparatuses 1 and 100 in this embodiment, lines of the curling detection pattern Pc with predetermined length in the direction perpendicular to the conveying direction is formed using black toner.

Consequently, it is possible to reduce effect of diffused light of the detection light from the curling detector 70*c*, and it is possible to enhance detecting precision of the curling detection pattern Pc by the curling detector 70*c* (i.e., curling of the endless belt such as the intermediate transfer belt 21 and the conveyance belt 101). As a result, it is possible to enhance the precision of the image formation adjustment.

In the color image forming apparatuses 1 and 100 in this embodiment, the curling detection pattern Pc whose interval is equal to or less than an interval of the toner position detection pattern Pt is formed.

Consequently, it is possible to detect the curling of the endless belt precisely based on the pattern interval of the curling detection pattern Pc and specify the toner position detection pattern Pt that is affected by the curling. As a result, it is possible to enhance the precision of the image formation adjustment.

Each of the functions of the described embodiments may be implemented by one or more processing circuits. A processing circuit includes a programmed processor, as a processor includes circuitry. A processing circuit also includes devices such as an application specific integrated circuit (ASIC) and conventional circuit components arranged to perform the recited functions.

Numerous additional modifications and variations are possible in light of the above teachings. It is therefore to be understood that, within the scope of the appended claims, the disclosure of this patent specification may be practiced otherwise than as specifically described herein.

As can be appreciated by those skilled in the computer arts, this invention may be implemented as convenient using a conventional general-purpose digital computer programmed according to the teachings of the present specification. Appropriate software coding can readily be prepared by skilled programmers based on the teachings of the present disclosure, as will be apparent to those skilled in the software arts. The present invention may also be implemented by the preparation of application-specific integrated circuits or by interconnecting an appropriate network of conventional component circuits, as will be readily apparent to those skilled in the relevant art.

Each of the functions of the described embodiments may be implemented by one or more processing circuits. A processing circuit includes a programmed processor. A processing circuit also includes devices such as an application specific integrated circuit (ASIC) and conventional circuit components arranged to perform the recited functions.

What is claimed is:

1. A curling detection device, comprising:

an endless belt entrained around at least two rollers;

a conveyance unit to convey the endless belt by driving the rollers;

an image forming unit to form an image by transferring a toner image to either a surface of the endless belt directly or to a recording medium on the endless belt;

a pattern image forming controller configured to instruct the image forming unit to form consecutive lines of a curling detection pattern at predetermined intervals in a conveying direction of the endless belt and a predetermined angle against the conveying direction of the endless belt at a predetermined timing;

a curling scanning unit to scan the curling detection pattern; and a detecting unit configured to detect a curling of the endless belt if a distance between at least two consecutive curling detection patterns scanned by the curling scanning unit is different from a curling status value, stored in a memory, for more than a predetermined amount.

2. The curling detection device according to claim 1, wherein the lines of the curling detection pattern having a predetermined length in a direction perpendicular to the conveying direction are formed using black toner.

3. An image forming apparatus, comprising:

an endless belt entrained around at least two rollers;

a conveyance unit to convey the endless belt by driving the rollers;

an image forming unit to form an image by transferring a toner image to either a surface of the endless belt directly or a recording medium on the endless belt;

a pattern image forming controller configured to instruct the image forming unit to form consecutive lines of a curling detection pattern at predetermined intervals in a conveying direction of the endless belt and a predetermined angle against the conveying direction of the endless belt and parallel lines of an image adjustment pattern laid out next to the curling detection pattern in a direction perpendicular to the conveying direction and at a predetermined angle to the perpendicular direction at a predetermined timing;

a curling scanning unit to scan the curling detection pattern;

an image status scanning unit to scan the image adjustment pattern;

an adjustment unit configured to adjust forming an image by the image forming unit based on the scanning result of the image adjustment pattern by the image status scanning unit;

a detecting unit configured to detect a curling of the endless belt if a distance between at least two consecutive curling detection patterns scanned by the curling scanning unit is different from a curling status value, stored in a memory, for more than a predetermined amount; and an image formation adjustment controller configured to control image formation adjustment by determining the image adjustment pattern used for adjusting image formation by the adjustment unit in accordance with the curling of the endless belt detected by the detecting unit.

4. The image forming apparatus according to claim 3, wherein the image formation adjustment controller instructs the adjustment unit to adjust image formation based on the image adjustment pattern excluding the image adjustment pattern at a position corresponding to the curling detection pattern in the direction perpendicular to the conveying direction on an area where curling exceeding a predetermined amount is detected by the detecting unit.

5. The image forming apparatus according to claim 3, wherein the lines of the curling detection pattern having a predetermined length in the direction perpendicular to the conveying direction are formed using black toner.

6. The image forming apparatus according to claim 3, wherein the curling detection pattern has an interval equal to or less than an interval of the image adjustment pattern.

7. A method of detecting curling of an endless conveyance belt, comprising the steps of:

conveying an endless belt entrained around at least two rollers by driving the rollers;

forming an image by transferring a toner image to either a surface of the endless belt directly or a recording medium on the endless belt;

forming consecutive lines of a curling detection pattern at predetermined intervals in a conveying direction of the endless belt and a predetermined angle against the conveying direction of the endless belt at a predetermined timing;

scanning the curling detection pattern; and detecting a curling of the endless belt if a distance between at least two consecutive scanned curling detection patterns is different from a curling status value, stored in a memory, for more than a predetermined amount.

8. A method of adjusting an image, comprising the steps of:

conveying an endless belt entrained around at least two rollers by driving the rollers;

forming an image by transferring a toner image to either a surface of the endless belt directly or a recording medium on the endless belt;

forming consecutive lines of a curling detection pattern at predetermined intervals in a conveying direction of the endless belt and a predetermined angle against the conveying direction of the endless belt and parallel lines of an image adjustment pattern laid out next to the curling detection pattern in a direction perpendicular to the conveying direction and at a predetermined angle to the perpendicular direction at a predetermined timing;

scanning the curling detection pattern;

scanning the image adjustment pattern;

adjusting the image formation based on the scanning result of the image adjustment pattern;

detecting a curling of the endless belt if a distance between at least two consecutive scanned curling detection patterns is different from a curling status value, stored in a memory, for more than a predetermined amount; and controlling image formation adjustment by determining the image adjustment pattern used for adjusting image formation in accordance with the detected curling of the endless belt.

9. A non-transitory, computer-readable recording medium storing a program that, when executed by a processor, causes the processor to implement a method of detecting a curling of an endless conveyance belt, comprising the steps of:

conveying an endless belt entrained around at least two rollers by driving the rollers;

forming an image by transferring a toner image to either a surface of the endless belt directly or a recording medium on the endless belt;

forming consecutive lines of a curling detection pattern at predetermined intervals in a conveying direction of the endless belt and a predetermined angle against the conveying direction of the endless belt at a predetermined timing;

scanning the curling detection pattern; and detecting a curling of the endless belt if a distance between at least two consecutive scanned curling detection patterns is different from a curling status value, stored in a memory, for more than a predetermined amount.

10. A non-transitory, computer-readable recording medium storing a program that, when executed by a processor, causes the processor to implement a method of adjusting an image, comprising the steps of:

conveying an endless belt entrained around at least two rollers by driving the rollers;

forming an image by transferring a toner image to either a surface of the endless belt directly or a recording medium on the endless belt;

forming consecutive lines of a curling detection pattern at predetermined intervals in a conveying direction of the endless belt and a predetermined angle against the conveying direction of the endless belt and parallel lines of an image adjustment pattern laid out next to the curling detection pattern in a direction perpendicular to the conveying direction and at a predetermined angle to the perpendicular direction at a predetermined timing;

scanning the curling detection pattern;

scanning the image adjustment pattern;

adjusting the image formation based on the scanning result of the image adjustment pattern;

detecting a curling of the endless belt if a distance between at least two consecutive scanned curling detection patterns is different from a curling status value, stored in a memory, for more than a predetermined amount; and controlling image formation adjustment by determining the image adjustment pattern used for adjusting image formation in accordance with the detected curling of the endless belt.

11. The curling detection device according to claim 1, wherein the detecting unit is further configured to detect the curling of the endless belt based on the distance between multiple curling detection patterns scanned by the curling scanning unit in the conveyance direction of the endless belt.

12. The image forming apparatus according to claim 3, wherein the detecting unit is further configured to detect the curling of the endless belt based on the distance between multiple curling detection patterns scanned by the curling scanning unit in the conveyance direction of the endless belt.

13. The method of detecting curling of an endless conveyance belt according to claim 7, further comprising detecting the curling of the endless belt based on distance between multiple scanned curling detection patterns in the conveyance direction of the endless belt.

14. The method of adjusting an image according to claim 8, further comprising detecting the curling of the endless belt based on distance between multiple scanned curling detection patterns in the conveyance direction of the endless belt.

15. The non-transitory, computer-readable medium according to claim 9 that, when executed by the processor, causes the processor to implement the step of detecting the curling of the endless belt based on distance between multiple scanned curling detection patterns in the conveyance direction of the endless belt.

16. The non-transitory, computer-readable medium according to claim 10 that, when executed by the processor, causes the processor to implement the step of detecting the curling of the endless belt based on distance between multiple scanned curling detection patterns in the conveyance direction of the endless belt.

17. The image forming apparatus according to claim 3, wherein the curling detection pattern is adjacent to the image adjustment pattern in the conveying direction and orthogonal to the image adjustment pattern in the conveying direction.

18. The method of adjusting an image according to claim 8, further comprising forming the curling detection pattern adjacent to the image adjustment pattern in the conveying direction and orthogonal to the image adjustment pattern in the conveying direction.

* * * * *